US009073727B2

(12) United States Patent
Solomon et al.

(10) Patent No.: US 9,073,727 B2
(45) Date of Patent: Jul. 7, 2015

(54) SYSTEMS AND METHODS FOR HANKING A CABLE

(71) Applicant: Apple Inc., Cupertino, CA (US)

(72) Inventors: Michael J. Solomon, Foster City, CA (US); Christopher Birgers, Cupertino, CA (US); Charles Werley, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/631,529

(22) Filed: Sep. 28, 2012

(65) Prior Publication Data

US 2013/0152508 A1 Jun. 20, 2013

Related U.S. Application Data

(60) Provisional application No. 61/577,588, filed on Dec. 19, 2011.

(51) Int. Cl.

| | |
|---|---|
| ***B65H 55/00*** | (2006.01) |
| ***B65H 54/62*** | (2006.01) |
| ***B65H 54/58*** | (2006.01) |

(52) U.S. Cl.

CPC ..... *B65H 54/62* (2013.01); *B65H 54/58* (2013.01); *B65H 2701/34* (2013.01)

(58) Field of Classification Search

CPC ..... B65D 85/66; B65H 54/58; B65H 54/62

USPC ..... 206/702, 410, 53, 54, 388, 303, 389, 206/395, 396; 24/16 R, 16 PB, 17 R, 115 R; 74/135; 248/74.3; 242/174, 164, 170, 242/171

See application file for complete search history.

(56) References Cited

U.S. PATENT DOCUMENTS

| | | | | | |
|---|---|---|---|---|---|
| 1,165,979 | A | * | 12/1915 | Knothe | 206/297 |
| 1,192,152 | A | * | 7/1916 | Atkinson | 24/17 R |
| 2,278,037 | A | * | 3/1942 | McIntire | 206/396 |
| 3,197,830 | A | * | 8/1965 | Hoadley | 24/16 PB |
| 3,290,453 | A | * | 12/1966 | Jensen | 191/12.4 |
| 3,796,304 | A | * | 3/1974 | Blais | 206/702 |
| 3,872,968 | A | * | 3/1975 | Hawkins et al. | 206/278 |
| 3,971,525 | A | | 7/1976 | Winslow | |
| 3,975,883 | A | | 8/1976 | Besnyo et al. | |
| 4,253,289 | A | | 3/1981 | Cole et al. | |
| 4,572,370 | A | * | 2/1986 | Cedenblad et al. | 206/398 |

(Continued)

FOREIGN PATENT DOCUMENTS

| | | |
|---|---|---|
| BE | 674854 | 5/1966 |
| CN | 2797303 | 7/2006 |

(Continued)

*Primary Examiner* — Steven A. Reynolds

(74) *Attorney, Agent, or Firm* — Van Court & Aldridge LLP

(57) ABSTRACT

Systems and methods for hanking a cable are disclosed. A hanked cable may be formed by winding the cable around two or more mandrels attached to support members of a winding fixture. At least one of the mandrels can be removeably attached to the winding fixture to facilitate clamping the cable between the mandrel and the support member. The distance between mandrels may be varied by including, in the winding fixture, an adjustable stage for adjusting the relative positions of the mandrels. Once the cable is wound into a hanked configuration, it may be wrapped with a semi-rigid wrapping member to help retain the hanked shape.

25 Claims, 15 Drawing Sheets

(56) References Cited

U.S. PATENT DOCUMENTS

| | | | | | |
|---|---|---|---|---|---|
| 4,684,163 | A * | 8/1987 | Anderson | 294/149 |
| 4,812,319 | A * | 3/1989 | Hsu et al. | 426/127 |
| 4,878,586 | A * | 11/1989 | Bancroft et al. | 211/106 |
| 5,104,076 | A * | 4/1992 | Goodall, Jr. | 248/205.2 |
| 5,129,514 | A * | 7/1992 | Lilley, Jr. | 206/388 |
| 5,577,932 | A * | 11/1996 | Palmer | 439/501 |
| 5,584,393 | A * | 12/1996 | Korte | 206/524.9 |
| 5,598,922 | A * | 2/1997 | Good | 206/299 |
| 5,642,866 | A * | 7/1997 | Nieding | 242/588.4 |
| 5,732,445 | A * | 3/1998 | Stodolka et al. | 24/16 R |
| 5,802,676 | A * | 9/1998 | Tolan | 24/16 R |
| 6,301,752 | B1 | 10/2001 | Koppang | |
| 6,349,452 | B1 * | 2/2002 | Cisneros | 24/306 |
| 6,425,165 | B2 * | 7/2002 | Koppang | 24/129 R |
| 6,467,132 | B1 * | 10/2002 | Robley | 24/16 PB |
| 6,523,229 | B2 * | 2/2003 | Severson | 24/16 PB |
| 6,554,217 | B1 | 4/2003 | Rodriguez | |
| 6,581,763 | B2 * | 6/2003 | Allgood et al. | 206/54 |
| D505,064 | S * | 5/2005 | Kampfer | D8/396 |
| 7,513,366 | B1 * | 4/2009 | Keating | 206/495 |
| 7,882,600 | B2 * | 2/2011 | Judd | 24/115 R |
| 2005/0126945 | A1 * | 6/2005 | Selby | 206/395 |
| 2007/0051662 | A1 * | 3/2007 | Millar-Sax et al. | 206/702 |

FOREIGN PATENT DOCUMENTS

| | | |
|---|---|---|
| EP | 0554230 | 8/1993 |
| GB | 1073781 | 6/1967 |
| JP | 57-156971 | 9/1982 |

* cited by examiner

SYSTEMS AND METHODS FOR HANKING A CABLE

CROSS-REFERENCE TO RELATED APPLICATION

This application claims the benefit of U.S. Provisional Application No. 61/577,588, filed Dec. 19, 2011, the disclosure of which is incorporated by reference herein in its entirety.

BACKGROUND

This document relates to systems and methods for hanking a cable. Cables are often hanked, wrapped, or wound for convenient, compact packaging. Typically, retaining a cable in a hanked configuration requires the use of twist ties or special recessed packaging features.

SUMMARY

Systems and methods for hanking a cable are disclosed. A hanked cable, according to some embodiments can include a length of cable with connectors on each end for connecting the cable between two electronic devices. The hanked cable can be looped on itself any suitable number of times such that the adjacent loops are flush with one another and the connectors terminate inside the loops. A semi-rigid wrapping member can be wrapped around the hanked cable and secured to itself with an adhesive. In some embodiments, the semi-rigid wrapping member may include a non-adhesive distal end that forms a tab to allow for easy removal of the semi-rigid wrapping member by a consumer. The hanked cable may be looped in roughly integer or half-integer increments that result in an "even" or "uneven" hanking, respectively, which may affect how well the connectors can fit within the loops of the hanked cable.

According to some embodiments, a cable may be hanked by winding it around elements of a winding fixture. The winding fixture can include a base member with an adjustable stage. Two support members, integrally formed, or coupled to one side of the base member may be included to support a pair of mandrels that are configured to extend perpendicularly from the base member. In some embodiments, one or both of the mandrels may be removeably coupled to the support members. Furthermore, one of the support members may be positioned above the adjustable stage to facilitate varying the distance between the mandrels and, therefore, accommodating cables of different lengths.

The support members can each include a recess configured to accept the proximal end of a mandrel, and one or both of the support members can additionally include a recess configured to accept at least one wrap of a cable. Each mandrel can include a slit configured to secure an end of a cable. According to some embodiments, a detachable, clamping mandrel may include a slit at its proximal end for securing a first end of a cable between the first mandrel and a support member, and a second, standing mandrel may include a slit at its distal end for securing the second end of the cable.

According to some embodiments, a method for cable hanking can include measuring a length of cable, adjusting an adjustable stage of a winding fixture to a position suitable for the length of cable, and winding the length of cable around mandrels extending from the winding fixture. According to some embodiments, the method may further include laying a first end of the length of cable in a semi-circular recess formed in a support member of the winding fixture and securing the first end of the length of cable within the semi-circular recess by inserting a detachable mandrel into a second recess in the support member.

After the first end of the cable is secured in the support member, the rest of the length of cable can be looped around the detachable mandrel and a second mandrel such that adjacent loops of the cable lie flush against each other. The second end of the cable can be secured in a slit in the distal end of the second mandrel with the connector extending into the space between the mandrels. The hanked cable can then be securely wrapped with a semi-rigid wrapping member, and the detachable mandrel and hanked cable can be ejected from the winding fixture.

BRIEF DESCRIPTION OF THE DRAWINGS

The above and other aspects of the invention, its nature, and various features will become more apparent upon consideration of the following detailed description, taken in conjunction with the accompanying drawings, in which like reference characters refer to like parts throughout, and in which.

DETAILED DESCRIPTION

Figure 1:
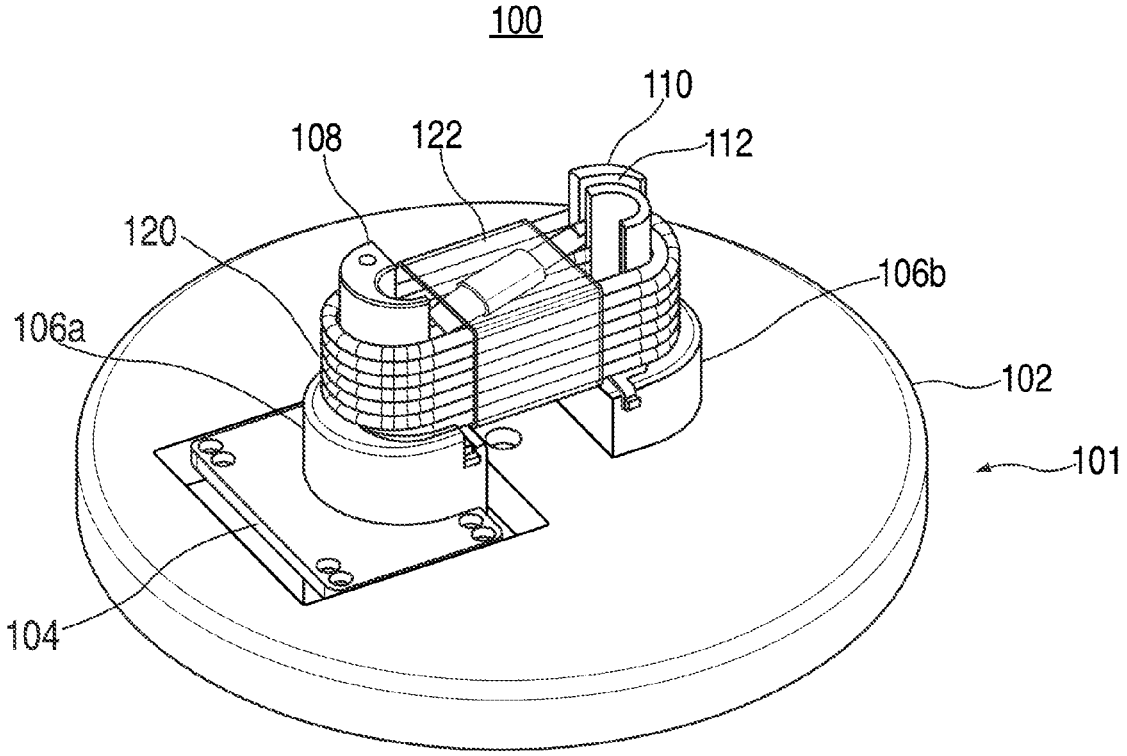
FIG. 1 is a perspective view of a cable hanking system in accordance with some embodiments.

FIG. 1 is a perspective view of a cable hanking system 100 in accordance with some embodiments. Cable hanking system 100 may include a winding fixture 101 for winding a cable 120. Winding fixture 101 can include a base member 102, an adjustable stage 104, support members 106*a* and 106*b*, a clamping mandrel 108, and a standing mandrel 110. Hanking system 100 can also include a semi-rigid wrapping member 122 wrapped around cable 120.

Base member 102 may be composed of any suitable material (e.g., a metal, a plastic, or a composite), and it may be formed in any suitable shape. As depicted in FIG. 1, base member 102 can be free standing; however, according to some embodiments, base member 102 may be the platform of a larger hanking system.

Winding fixture 101 can also include two or more support members 106*a* and 106*b* extending from a top surface of base member 102. Support members 106 may be formed integrally with base member 102 (e.g., in a molding process). Alternatively, support members 106 may be physically coupled to base 102 with, for example, an adhesive or a clip mechanism. In some embodiments, support members 106 can be fixedly disposed at a predetermined distance from one another. In those embodiments, the winding fixture may be suitable for hanking cables of a fixed and predetermined length. In other embodiments, one or more support members 106 can be positioned on adjustable stage 104.

Adjustable stage 104 can be disposed within a recess of base member 102 and configured to have a top surface that is coplanar with the top surface of base member 102. Any suitable mechanism may facilitate movement of adjustable stage 104 with respect to base member 102. For example, the mechanism may be a track that permits one, two, or three-dimensional movement of the stage. In embodiments in which one or more support members 106 is positioned on adjustable stage 104, the distance between support members 106 can be varied by moving the stage(s) with respect to base member 102. Varying the distance between support members 106 may allow the winding fixture to accommodate the hanking of cables of varying lengths.

A pair of mandrels, clamping mandrel 108 and standing mandrel 110, can be physically coupled to support members 106. Mandrels 108 and 110 can be used, generally, as posts around which cable 120 can be wound. Additionally, each mandrel can include features specially configured to facilitate starting and ending the cable winding process. For example, clamping mandrel 108 can include a slit at its proximal end (not shown in FIG. 1) for clamping a first end of cable 120 between clamping mandrel 108 and support member 106. Standing mandrel 110 can have a similar slit 112 at its distal end for holding the second end of cable 120.

After cable 120 is wound around mandrels 108 and 110 of winding fixture 101, a semi-rigid wrapping member 122 can be wrapped around the hanked cable and secured to itself (e.g., with an adhesive). Semi-rigid wrapping member 122 may be a preformed plastic strip that encourages cable 120 to remain in the hanked configuration obtained during the winding process. In some embodiments, semi-rigid wrapping member 122 can be composed of oriented polypropylene ("OPP") or other material with characteristics suitable for maintaining the shape of hanked cable 120.

Figure 2:
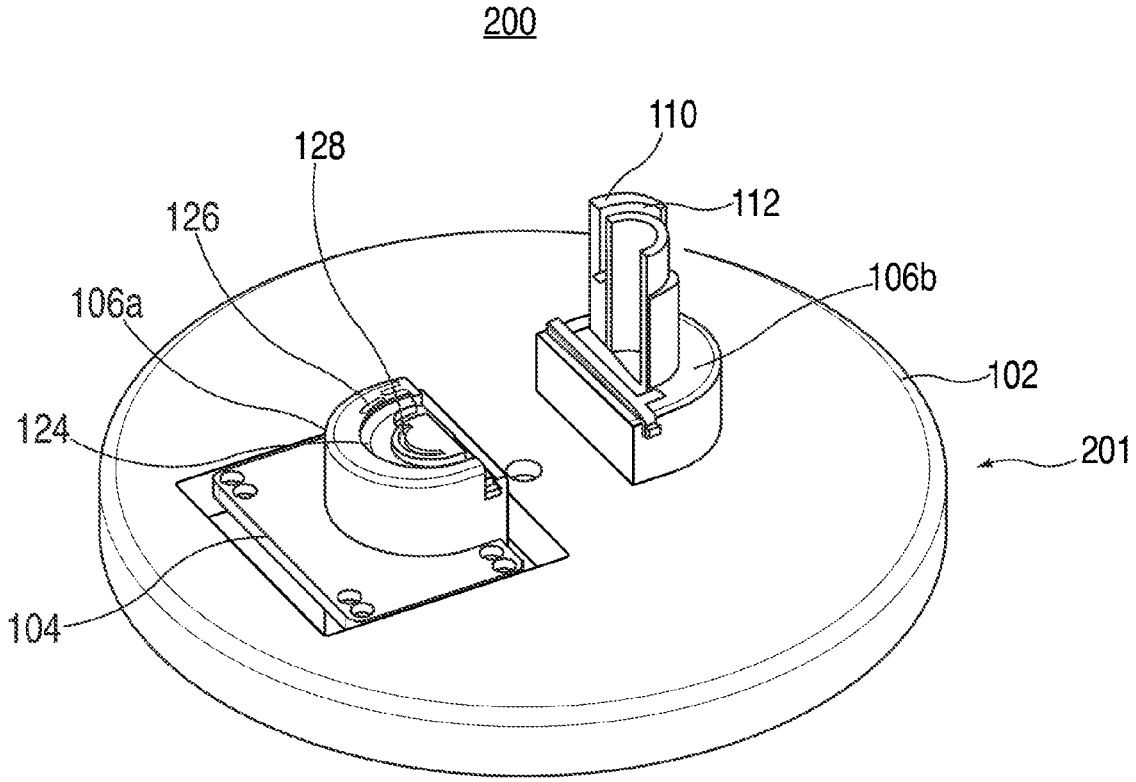
FIGS. 2-9 are perspective views of a cable hanking system subassembly in accordance with some embodiments.

FIG. 2 is a perspective view of a cable hanking system subassembly 200 in accordance with some embodiments. Subassembly 200 may represent a partially assembled version of cable hanking system 100 of FIG. 1. In particular, subassembly 200 is depicted without clamping mandrel 108, cable 120 and semi-rigid wrapping member 122.

As depicted in FIG. 2, support member 106*a* can include a number of recesses 124, 126, and 128. Recess 124 may be shaped as a semi-circle and configured to receive at least one wind of a cable. For example, a connector of a first end of a cable (e.g., cable 120 of FIG. 1) can be disposed in the space between support members 106*a* and 106*b*. The section of cable proximal to the connecter can then be laid in the semi-circular recess 124 to begin the winding process.

Once the cable has been laid in recess 124, a clamping mandrel (e.g., clamping mandrel 108 of FIG. 1) can be inserted into recesses 126 and 128. To ensure that the cable is held in place during the winding process, the clamping mandrel can include a slit between portions that are configured to fit within semi-circular recess 128 and outer recess 126. According to some embodiments, the clamping mandrel may be configured to securely engage support member 106*a* (e.g., by snapping into a clip). In those embodiments, support member 106*a* can include a mechanism for ejecting the clamping mandrel (e.g., at the end of the winding process). In other embodiments, the clamping mandrel may be inserted into and removed from support member 106*a* without any significant resistance.

Figure 3:
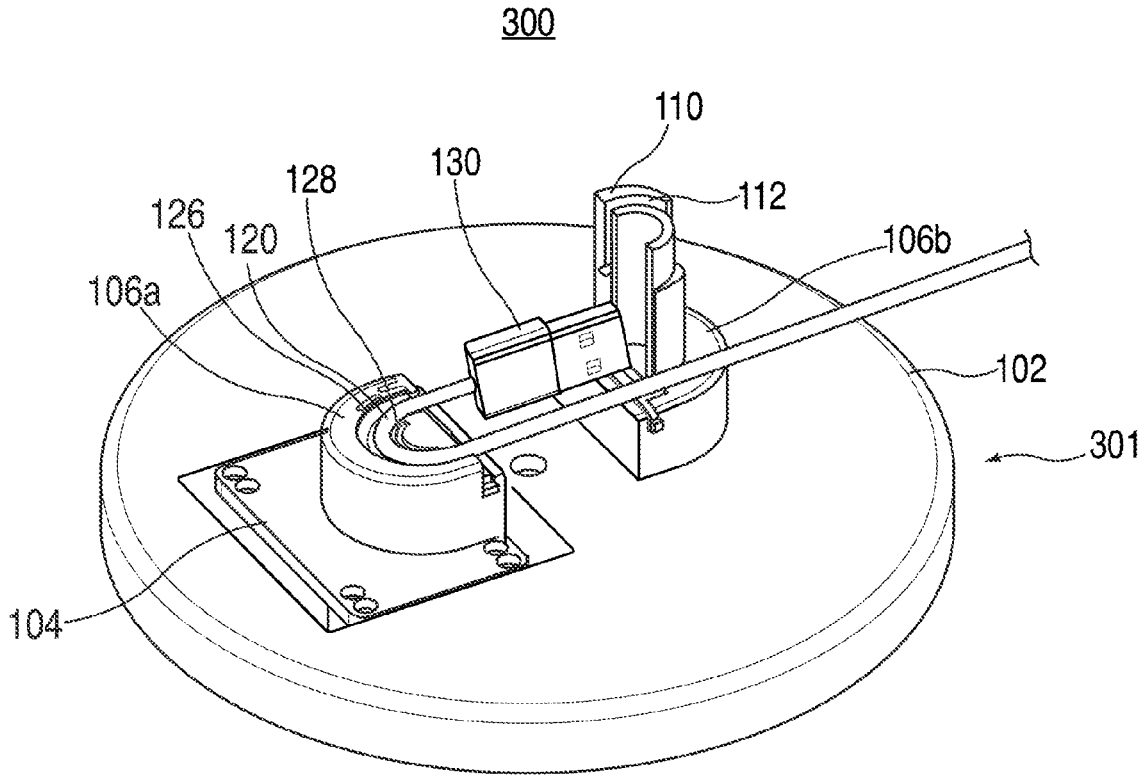
Figure 4:
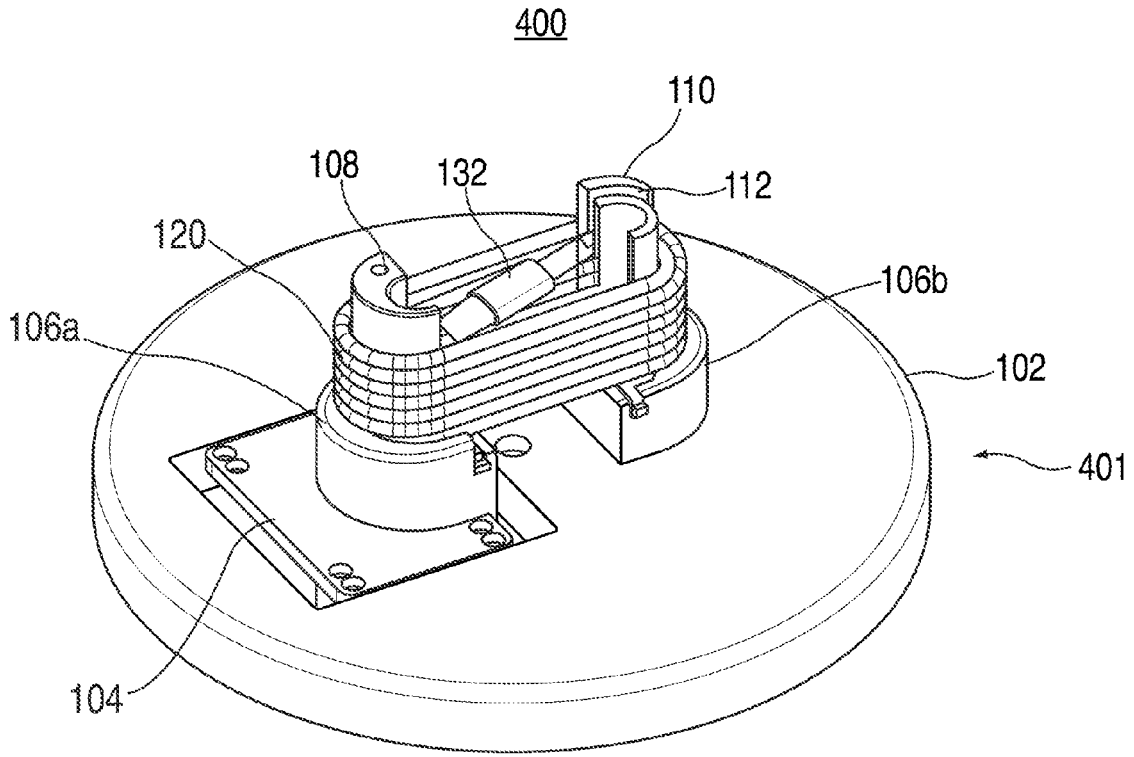

FIG. 3 is a perspective view of a cable hanking system subassembly 300 in accordance with some embodiments. Subassembly 300 shows cable 120 placed inside recess 124 of winding member 301 at the start of an exemplary winding process. Connector 130 is disposed in the space between support member 106*a* and 106*b*. Cable 120 may be wound around clamping mandrel 108 (not shown in FIG. 3) and standing mandrel 110 until its entire length is wrapped around the mandrels, with each adjacent loop flush with one another. The second end of cable 120 can be tucked into slit 112, leaving connector 132 within the loops of the hanked cable, as depicted in FIG. 4.

In some embodiments, the winding process may be machine controlled. For example, base member 102 may be, or may be coupled to, a rotating platform. Once the first end of cable 120 is clamped between clamping mandrel 108 and support member 106*a*, the platform can begin to rotate (e.g., under the power of a motor). The second end of cable 120 may be kept under tension during the winding process, which can result in a neat, clean hank. Alternatively, base member 102 may remain stationary while a machine winds cable 120 around clamping mandrel 108 and standing mandrel 110. In other embodiments, the winding process may be performed manually.

Figure 5:
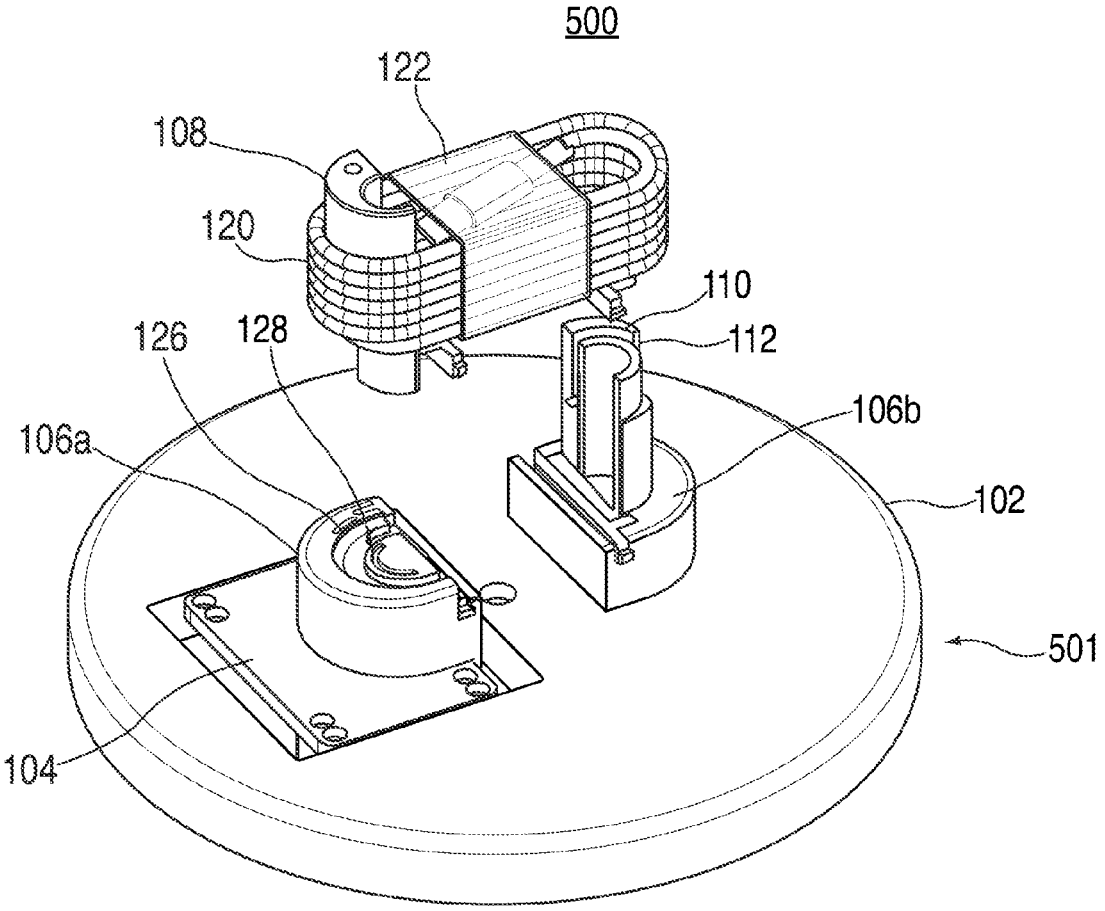

FIG. 5 is a perspective view of a cable hanking system subassembly 500 in accordance with some embodiments. In particular, FIG. 5 depicts hanked cable 120 wrapped with semi-rigid wrapping member 122 ejected from winding fixture 501. Cable 120 can be ejected from winding fixture 501 by disengaging clamping mandrel 108 from support member 106*a*. Clamping mandrel 108 may be disengaged from support member 106*a* by, for example, pulling it away from the support member. In embodiments where clamping mandrel 108 snaps into support member 106*a*, ejecting cable 120 may require the activation of a disengagement mechanism.

Figure 6:
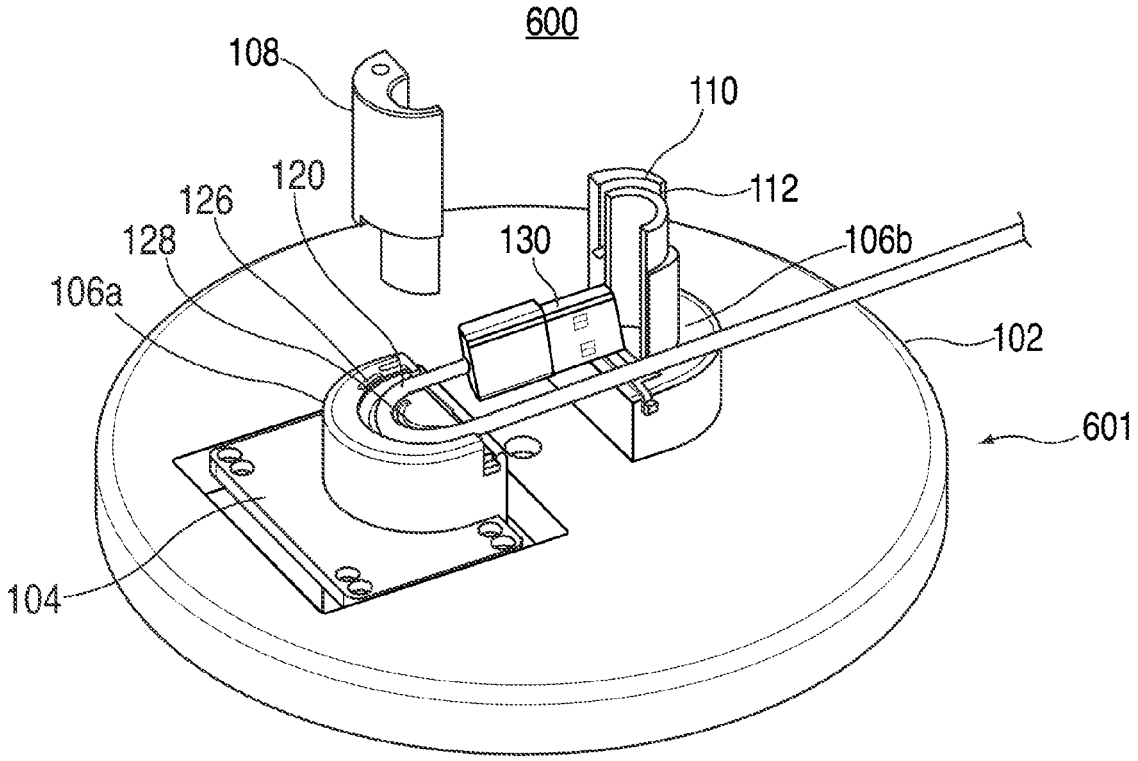

FIG. 6 is a perspective view of a cable hanking system subassembly 600 in accordance with some embodiments. As depicted in FIG. 6, clamping mandrel 108 can be a removable member that acts to clamp cable 120 within a recess of support member 106*a*. Clamping mandrel 108 can be disengaged from support member 106*a* of winding fixture 601 when cable 120 is inserted into support member 106*a*. Then, prior to wrapping cable 120 into a hanked configuration, clamping mandrel 108 can be inserted into support member 106*a*, thus clamping cable 120 in place. Cable 120 can then be wrapped around clamping mandrel 108 and standing mandrel 110.

Figure 7:
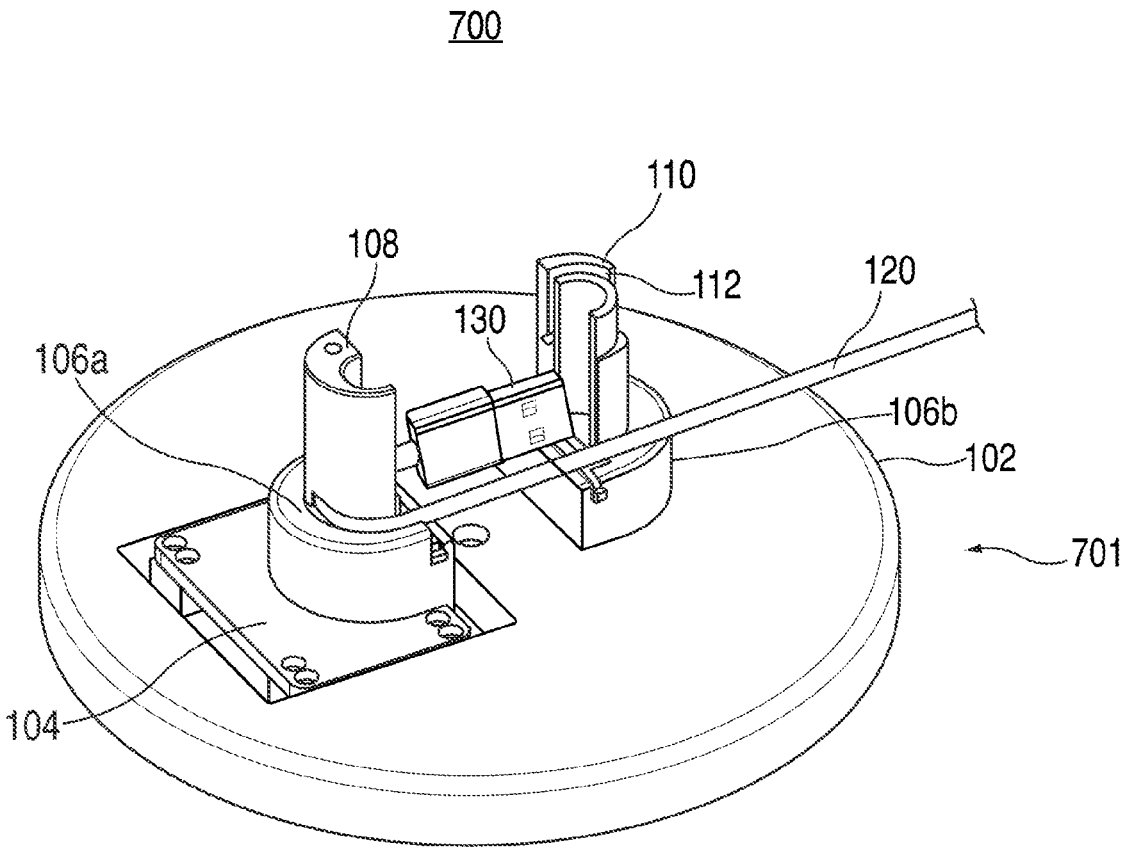

FIG. 7 is a perspective view of a cable hanking system subassembly 700 in accordance with some embodiments. As depicted in FIG. 7, clamping mandrel 108 is inserted into support member 106*a*. According to some embodiments clamping mandrel 108 can be secured within support member 106*a* using a latching mechanism (e.g., a clip or a hook). In other embodiments, clamping mandrel 108 can be set within support member 106*a* without a securing latching mechanism. Connector 130 can reside in the space between clamping mandrel 108 and standing mandrel 110 such that when cable 120 is wrapped into a hanked configuration, connector 130 is disposed inside the loops of the hanked cable.

Figure 8:
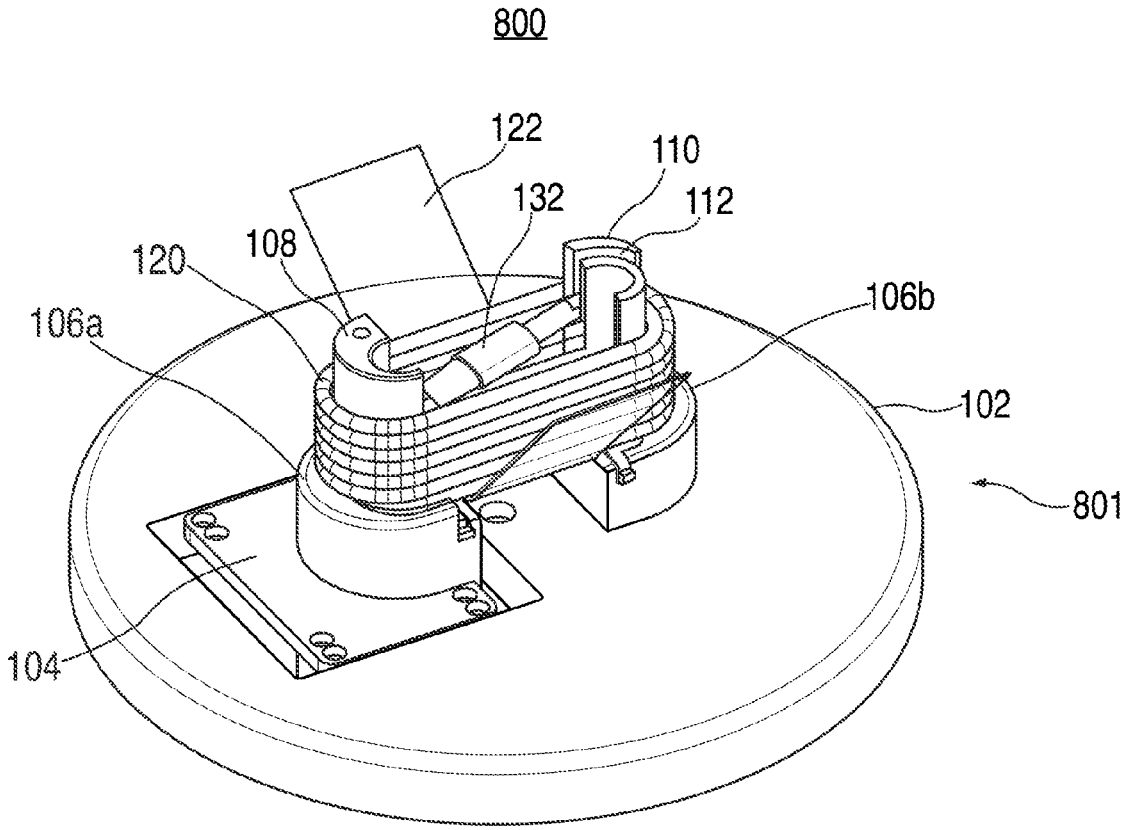

FIG. 8 is a perspective view of a cable hanking system subassembly 800 in accordance with some embodiments. As depicted in FIG. 8, cable 120 can be wrapped around clamping mandrel 108 and standing mandrel 110. Cable 120 can be secured within slit 112 such that connector 132 is disposed inside the loops of cable 120 and between clamping mandrel 108 and standing mandrel 110. Once cable 120 is fully wrapped around clamping mandrel 108 and standing mandrel 110 and connector 132 is tucked into the loops of cable 120, semi-rigid wrapping member 122 can be wrapped around cable 120. Semi-rigid wrapping member 122 can be fully wrapped around cable 120 and held in place with an adhesive to retain cable 120 in the wrapped, hanked configuration shown in FIG. 8.

Figure 9:
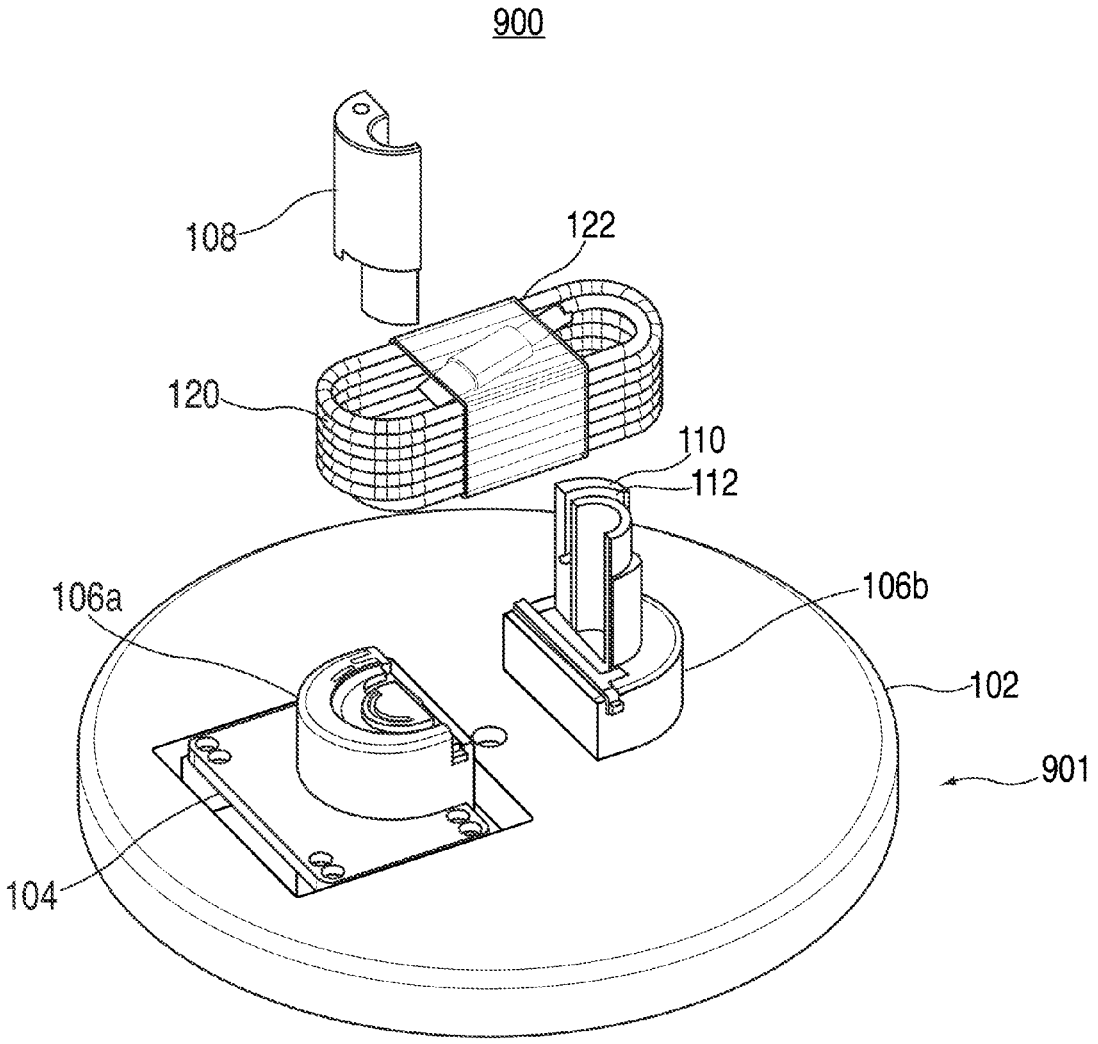

FIG. 9 is a perspective view of a cable hanking system subassembly 900 in accordance with some embodiments. As depicted in FIG. 9, clamping mandrel 108 can be removed from support member 106*a* to enable removal of hanked cable 120 from winding fixture 901.

Figure 10A:
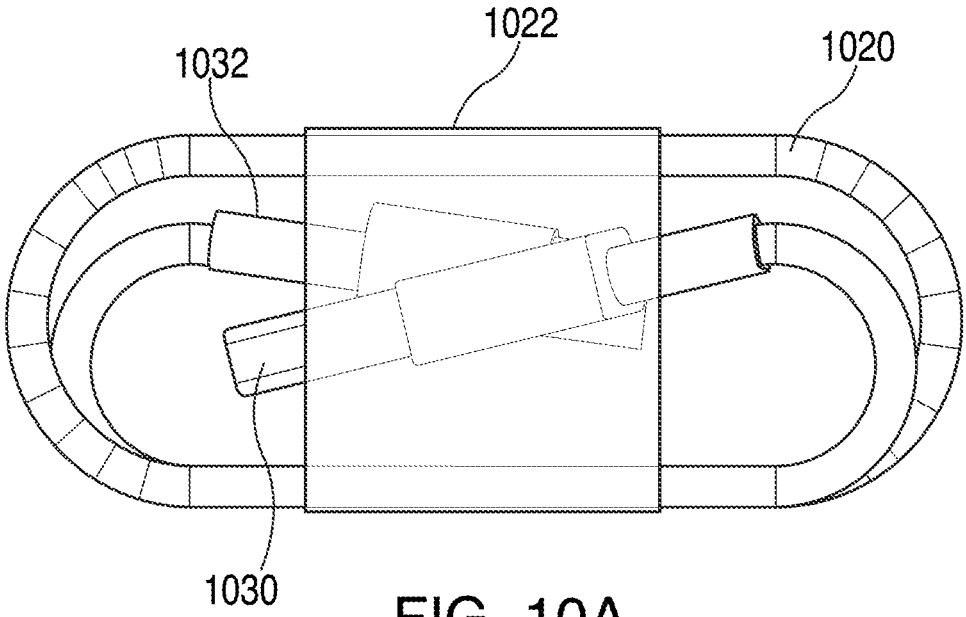
FIGS. 10A-D are alternative views of a hanked cable in accordance with some embodiments.
Figure 10B:
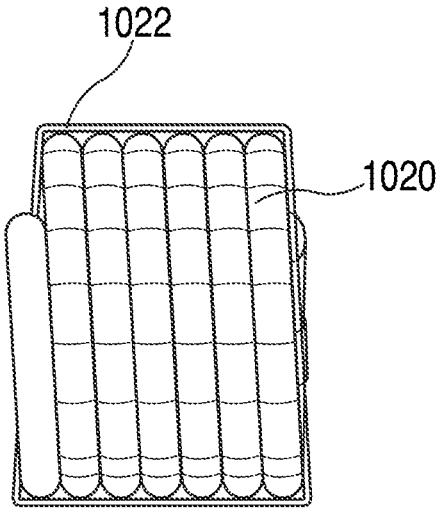
Figure 10C:
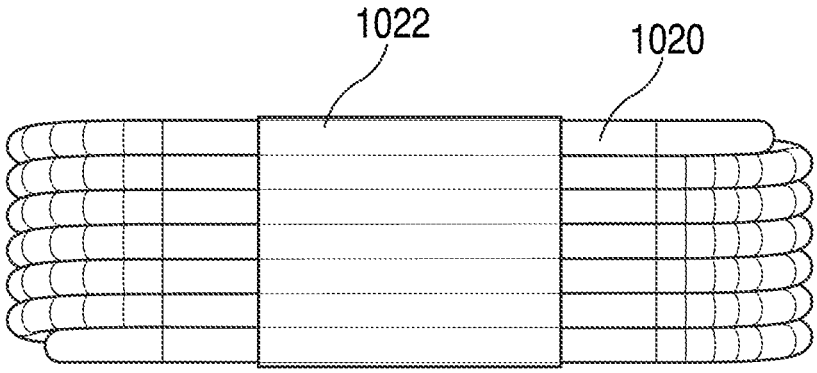
Figure 10D:
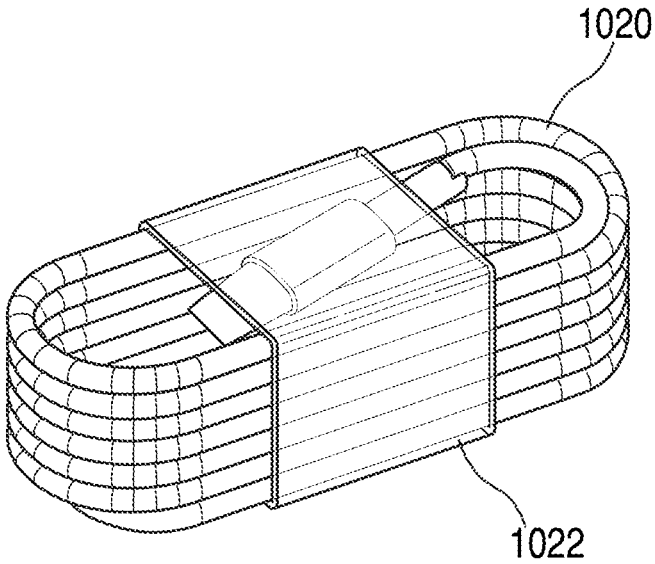

FIGS. 10A-D show various views of an unevenly wrapped hanked cable 1020 in accordance with some embodiments. In particular, FIG. 10A shows a top view of unevenly wrapped hanked cable 1020; FIG. 10B shows a first side elevation view of unevenly wrapped hanked cable 1020; FIG. 10C shows a second side elevation view of unevenly wrapped hanked cable 1020; and FIG. 10D shows a perspective view of unevenly wrapped hanked cable 1020.

Unevenly wrapped hanked cable 1020 can include connectors 1030 and 1032 disposed within the loops of hanked cable 1020 and semi-rigid wrapping member 1022 wrapped around its flat ends. An uneven wrap (i.e., one with more winds of the cable on one side than the other) may allow connectors 1030 and 1032 to be hidden within the loops of hanked cable 1020 more easily than if hanked cable 1020 was evenly wrapped because each connector in an unevenly wrapped cable enters the void created between the loops of hanked cable 1020 from opposing sides in both the vertical and lateral directions.

Figure 11A:
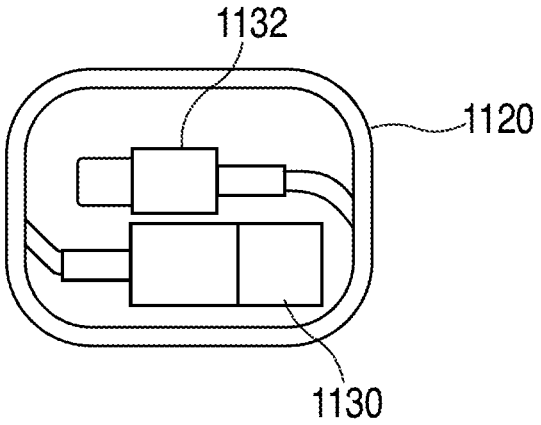
FIGS. 11A and 11B are different views of a rectangular hanked cable in accordance with some embodiments.
Figure 11B:
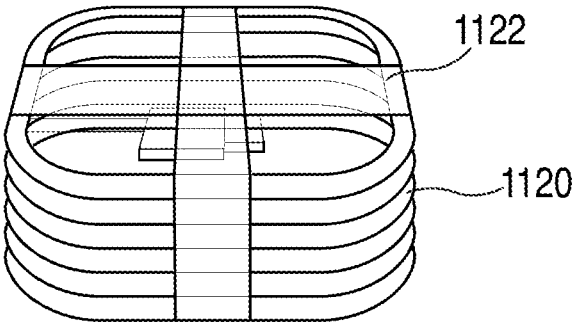

FIGS. 11A and 11B are different views of a rectangular hanked cable 1120 in accordance with some embodiments. In particular, FIG. 11A shows a top view of rectangular hanked cable 1120 including connectors 1130 and 1132 disposed within the loops of the cable. FIG. 11B shows a perspective view of hanked cable 1120 including semi-rigid wrapping member 1122. Hanked cable wrap variations, including rectangular hanked cable 1120, may be created, for example, using a winding fixture that includes more and/or differently shaped mandrels than those depicted in the embodiments shown in FIGS. 1-10. For instance, in some embodiments a winding fixture may include four mandrels arranged at the four corners of a square or rectangle. Those embodiments can result in a hanked cable with four flat sides as shown in FIG. 11A. A person skilled in the art will appreciate that the "corners" of a rectangular hanked cable may be rounded with any suitable bend radius. The bend radius may depend on a number of factors including the ductility and gauge of the cable and the thickness of any insulation encasing the cable.

Hanked cables with different configurations may require semi-rigid wrapping members of differing shapes to maintain the shape obtained during the winding process. For example, a cross-shaped semi-rigid wrapping member 1122 may be suitable for maintaining the shape of hanked cable 1120 of FIGS. 11A and 11B. Other hanked cable configurations (e.g., triangular, pentagonal, hexagonal, or irregular configurations) may be created by alternative mandrel placement and design and are expressly contemplated as within the scope of the embodiments disclosed herein.

Figure 12A:
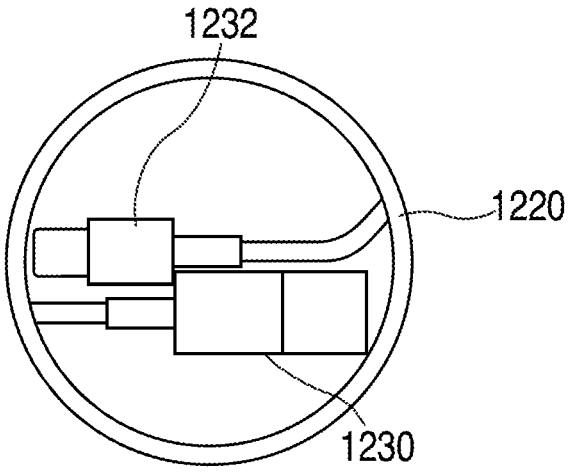
FIGS. 12A and 12B are different views of a circular hanked cable in accordance with some embodiments.
Figure 12B:
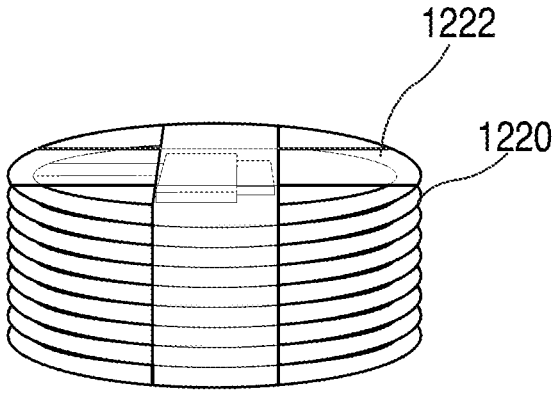

FIGS. 12A and 12B are different views of a circular hanked cable in accordance with some embodiments. In particular, FIG. 12A shows a top view of circular hanked cable 1220 including connectors 1230 and 1232 disposed within the loops of the cable. FIG. 12B shows a perspective view of circular hanked cable 1220 including semi-rigid wrapping member 1222. In some embodiments, a winding fixture may include a number of mandrels arranged in a circular formation. These embodiments may result in a hanked cable with a circular shape, as shown in FIG. 12A. A cross-shaped semi-rigid wrapping member 1222 may be suitable for maintaining the shape of hanked cable 1220 of FIG. 12A.

Figure 13A:
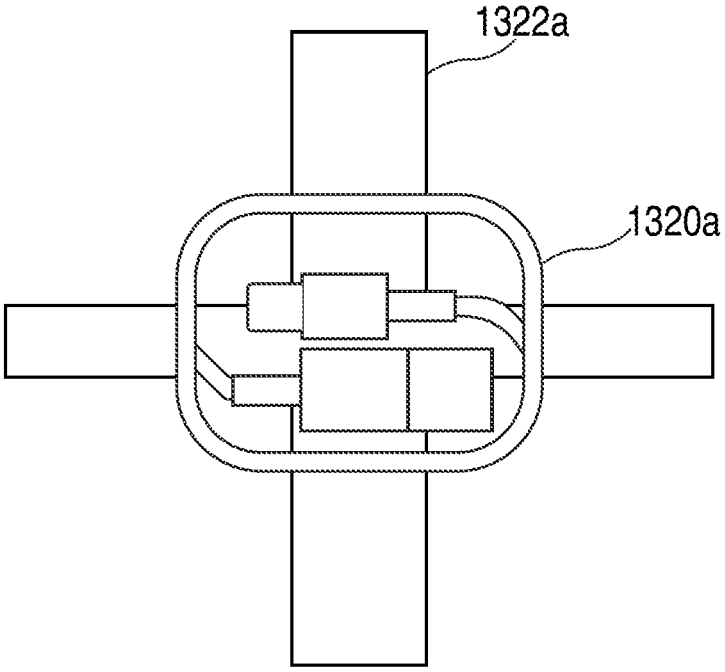
FIGS. 13A and 13B are top views of hanked cables and semi-rigid wrapping members in accordance with some embodiments.
Figure 13B:
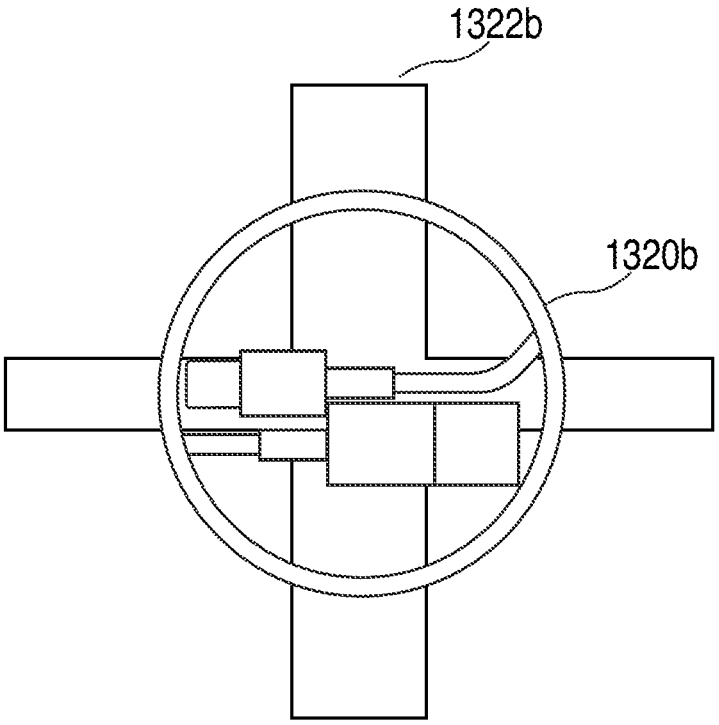

FIGS. 13A and 13B are top views of hanked cables and semi-rigid wrapping members in accordance with some embodiments. In particular, rectangular hanked cable 1320*a* of FIG. 13A may correspond to, for example, hanked cable 1120 of FIG. 11A. Cross-shaped semi-rigid winding member 1322*a* may be configured to wrap around the four flat edges of hanked cable 1320*a* and meet in the center of the loops. Similarly, circular hanked cable 1320*b* of FIG. 13B may be wrapped in cross-shaped semi-rigid wrapping member 1322*b*.

Figure 14:
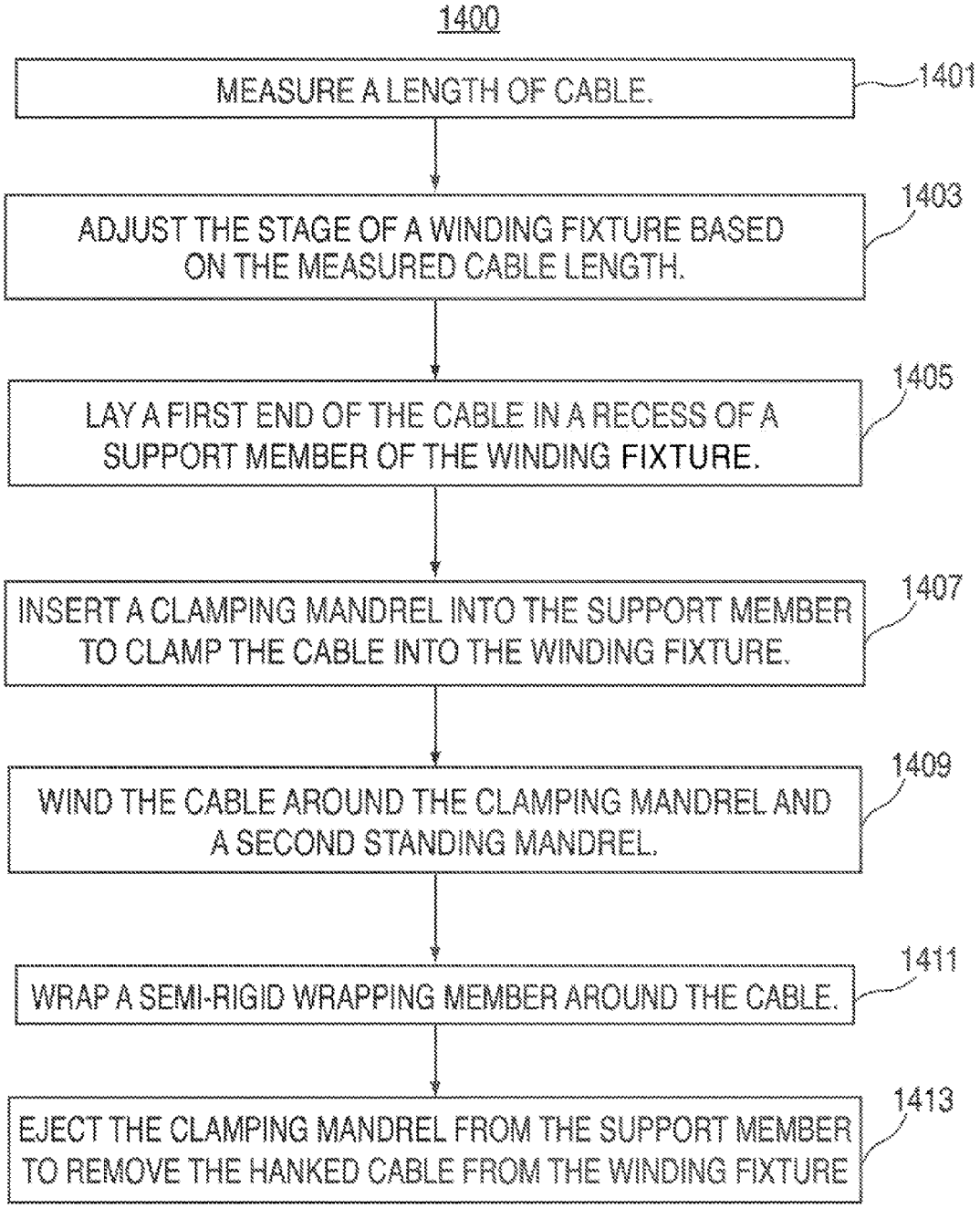
FIG. 14 is a flowchart depicting an example process for hanking a cable in accordance with some embodiments.

FIG. 14 is a flowchart of a process 1400 for hanking a cable in accordance with some embodiments. Process 1400 can begin at step 1401, in which a length of cable to be hanked can be measured. Measurement of the cable may be carried out in any suitable way. For example, a user may manually measure a length of cable extending between two connectors with a ruler or other suitable measuring device. In other embodiments, a machine can measure a cable and feed the measurement to a computer that is configured to adjust the stage of a winding fixture (e.g., winding fixture 101 of FIG. 1).

In step 1403, the adjustable stage (e.g., adjustable stage 104 of FIG. 1) of the winding fixture can be adjusted. In embodiments in which a computer is configured to adjust the adjustable stage, step 1403 may be completed automatically after the cable is measured in step 1401. However, in other embodiments, the adjustable stage may be adjusted manually to a setting appropriate for the cable measured in step 1401. In those embodiments, a scaled ruler may be marked on the base member (e.g., base member 102) of the winding fixture to facilitate precise adjustable stage positioning.

Next, at step 1405 a first end of a cable can be laid in a recess of a first support member (e.g., recess 124 in support member 106*a* of FIG. 2) of the winding fixture. The recess may be configured in a semi-circular shape that forces a connector of the cable to be disposed in the space between the mandrels of the winding fixture and creates the first wind of the cable on the winding fixture. Depending on the configuration of the winding fixture mandrels, however, the recess may take on a different shape. For example, if the cable is to be hanked into a square or rectangular configuration (e.g., hanked cable 1120 of FIG. 11A), the recess may be "L-shaped."

In step 1407, a clamping mandrel (e.g., clamping mandrel 108 of FIG. 1) can be inserted into the first support member to clamp the cable between the clamping mandrel and the support member. The clamping mandrel can be inserted into additional recesses in the first support member (e.g., recesses 126 and 128 of FIG. 2). A slit formed in the proximal side of the clamping mandrel can be configured to secure the first end of the cable in the winding fixture.

Next, in step 1409, the cable can be wound around the mandrels coupled to the winding fixture (e.g., clamping mandrel 108 and standing mandrel 110 of FIG. 1). In some embodiments, a machine may wind the cable automatically (e.g., by rotating the base member of the winding fixture while keeping tension on the second end of the cable). In other embodiments, an operator may manually wind the cable around the mandrels. When the full length of the cable has been wound around the mandrels, the second end of the cable can be secured in a slit in the distal end of the second mandrel (e.g., slit 112 of FIG. 1) with the second connector extending into the space between the mandrels.

At step 1411, a semi-rigid wrapping member (e.g., semi-rigid wrapping member 122 of FIG. 1) can be wrapped around the hanked cable and secured to itself (e.g., with an adhesive). The semi-rigid wrapping member may be composed of, for example, an oriented polypropylene ("OPP"). In some embodiments, a small tab of the semi-rigid wrapping member without adhesive backing may be left to permit a consumer to easily remove the semi-rigid wrapping member and uncoil the hanked cable.

Next, at step 1413, the clamping mandrel can be ejected from the support member to facilitate removal of the hanked cable from the winding fixture. In some embodiments, the clamping mandrel may be clipped into the support member and may require the engagement of an ejection mechanism for removal. In other embodiments, the clamping mandrel may be simply set into the recesses of the support member and held in place with a downward acting force (e.g., gravity, an operator's hand, the arm of a machine, etc.). In those embodiments, the clamping mandrel may simply be lifted out of the support member to facilitate removal of the hanked cable from the winding fixture.

It is to be understood that the steps shown in process 1400 of FIG. 14 are merely illustrative and that existing steps may be modified or omitted, additional steps may be added, and the order of certain steps may be altered.

While there have been described systems and methods for hanking a cable, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The described embodiments of the invention are presented for the purpose of illustration and not of limitation.

What is claimed is:

1. A hanked cable, comprising:

a length of cable comprising a first connector coupled to a first end of the length of cable and a second connector coupled to a second end of the length of cable, wherein the length of cable is coiled into a hanked configuration comprising a first number of turns on a first side and a second number of turns on a second side, wherein the first connector enters a void within the hanked configuration from the bottom of the first side, and wherein the second connector enters the void from the top of one of the first side and the second side; and a semi-rigid wrapping member wrapped around the cable and secured to itself with an adhesive.

2. The hanked cable of claim 1, wherein the first number of turns is different from the second number of turns.

3. The hanked cable of claim 1, wherein the first number of turns is equal to the second number of turns.

4. The hanked cable of claim 1, wherein the first connector and the second connecter are disposed within the void of the hanked cable.

5. The hanked cable of claim 1, wherein the semi-rigid wrapping member comprises oriented polypropylene ("OPP").

6. The hanked cable of claim 1, comprising two flat sides, wherein the two flat sides are the first side and the second side.

7. The hanked cable of claim 6, wherein the semi-rigid wrapping member comprises a strip wrapped around the first side and the second side of the hanked cable.

8. The hanked cable of claim 1, comprising four flat sides, wherein two of the four flat sides are the first side and the second side.

9. The hanked cable of claim 8, wherein the semi-rigid wrapping member comprises a cross-shaped member configured to wrap around the four sides and attach to itself with the adhesive.

10. The hanked cable of claim 1, wherein the semi-rigid wrapping member is preformed to exert a preloading force to the first and second sides.

11. A hanked cable assembly, comprising:

a cable comprising a first end and a second end;

a first connector coupled to the first end of the cable; and a second connector coupled to the second end of the cable, wherein:

a length of the cable extending at least partially between the first end of the cable and the second end of the cable is disposed in a hanked configuration;

the hanked configuration comprises a plurality of loops of the length of the cable;

adjacent loops of the plurality of loops lie flush with one another in a vertical direction of the hanked configuration;

the first connector and the second connector are disposed inside the plurality of loops;

the sum of the height of the first connector along the vertical direction and the height of the second connector along the vertical direction is less than the height of the plurality of loops along the vertical direction;

the hanked cable assembly further comprises a wrapping member that secures the length of the cable in the hanked configuration;

the wrapping member secures the first connector and the second connector inside the plurality of loops and between a first portion of the wrapping member and a second portion of the wrapping member;

a line extending along the vertical direction inside the plurality of loops intersects both the first connector and the second connector.

12. The hanked cable assembly of claim 11, wherein the line extending along the vertical direction inside the plurality of loops intersects the first connector, the second connector, the first portion of the wrapping member, and the second portion of the wrapping member.

13. A hanked cable assembly, comprising:

a cable comprising a first end and a second end;

a first connector coupled to the first end of the cable; and a second connector coupled to the second end of the cable, wherein:

a length of the cable extending at least partially between the first end of the cable and the second end of the cable is disposed in a hanked configuration;

the hanked configuration comprises a plurality of loops of the length of the cable;

adjacent loops of the plurality of loops lie flush with one another in a vertical direction of the hanked configuration;

the first connector and the second connector are disposed inside the plurality of loops;

the sum of the height of the first connector along the vertical direction and the height of the second connector along the vertical direction is less than the height of the plurality of loops along the vertical direction;

the hanked cable assembly further comprises a wrapping member that secures the length of the cable in the hanked configuration;

the wrapping member secures the first connector and the second connector inside the plurality of loops and between a first portion of the wrapping member and a second portion of the wrapping member; and the first end of the cable and the second end of the cable enter the inside of the plurality of loops from opposing sides of the plurality of loops along the vertical direction.

14. A hanked cable assembly, comprising:
a cable comprising a first end and a second end;
a first connector coupled to the first end of the cable; and
a second connector coupled to the second end of the cable, wherein:
a length of the cable extending at least partially between the first end of the cable and the second end of the cable is disposed in a hanked configuration;
the hanked configuration comprises a plurality of loops of the length of the cable;
adjacent loops of the plurality of loops lie flush with one another in a vertical direction of the hanked configuration;
the first connector and the second connector are disposed inside the plurality of loops;
the sum of the height of the first connector along the vertical direction and the height of the second connector along the vertical direction is less than the height of the plurality of loops along the vertical direction;
the hanked cable assembly further comprises a wrapping member that secures the length of the cable in the hanked configuration;
the wrapping member secures the first connector and the second connector inside the plurality of loops and between a first portion of the wrapping member and a second portion of the wrapping member; and
the first end of the cable and the second end of the cable enter the inside of the plurality of loops from opposing sides of the plurality of loops along a lateral direction that is perpendicular to the vertical direction.

15. The hanked cable assembly of claim 13, wherein the first end of the cable and the second end of the cable enter the inside of the plurality of loops from opposing sides of the plurality of loops along a lateral direction that is perpendicular to the vertical direction.

16. A hanked cable assembly, comprising:
a cable comprising a first end and a second end;
a first connector coupled to the first end of the cable; and
a second connector coupled to the second end of the cable, wherein:
a length of the cable extending at least partially between the first end of the cable and the second end of the cable is disposed in a hanked configuration;
the hanked configuration comprises a plurality of loops of the length of the cable;
adjacent loops of the plurality of loops lie flush with one another in a vertical direction of the hanked configuration;
the first connector and the second connector are disposed inside the plurality of loops;
the first connector and the second connector enter the inside of the plurality of loops from opposing sides of the plurality of loops along a lateral direction that is perpendicular to the vertical direction; and
a line extending along the vertical direction inside the plurality of loops intersects both the first connector and the second connector.

17. The hanked cable assembly of claim 16, wherein the first connector and the second connector enter the inside of the plurality of loops from opposing sides of the plurality of loops along the vertical direction.

18. The hanked cable assembly of claim 16, wherein:
the hanked cable assembly further comprises a wrapping member that secures the length of the cable in the hanked configuration; and
the line extending along the vertical direction inside the plurality of loops intersects a first portion of the wrapping member, then the first connector, then the second connector, and then a second portion of the wrapping member.

19. The hanked cable assembly of claim 16, wherein no two adjacent loops of the plurality of loops lie flush with one another in the lateral direction.

20. A hanked cable assembly, comprising:
a cable comprising a first end and a second end;
a first connector coupled to the first end of the cable; and
a second connector coupled to the second end of the cable, wherein:
a length of the cable extending at least partially between the first end of the cable and the second end of the cable is disposed in a hanked configuration;
the hanked configuration comprises a plurality of loops of the length of the cable;
a first loop of the plurality of loops lies flush against a second loop of the plurality of loops in a vertical direction of the hanked configuration; and
a first cross-sectional area of the first loop in a first plane perpendicular to the vertical direction is the same as a second cross-sectional area of the second loop in a second plane perpendicular to the vertical direction.

21. The hanked cable assembly of claim 20, wherein:
the size of the first loop of in the first plane is the same as the size of the second loop in the second plane; and
the shape of the first loop of in the first plane is the same as the shape of the second loop in the second plane.

22. The hanked cable assembly of claim 20, wherein an outer periphery of the hanked configuration along a third plane parallel to the vertical direction comprises a portion of each one of the first loop and the second loop.

23. The hanked cable assembly of claim 20, wherein the first connector and the second connector are disposed inside the plurality of loops.

24. The hanked cable assembly of claim 20, wherein a line extending along the vertical direction inside the plurality of loops intersects both the first connector and the second connector.

25. The hanked cable assembly of claim 20, wherein:
the hanked cable assembly further comprises a wrapping member that secures the length of the cable in the hanked configuration; and
the wrapping member secures the first connector and the second connector inside the plurality of loops and between a first portion of the wrapping member and a second portion of the wrapping member.

* * * * *